US005704180A

United States Patent [19]

Boeck

[11] Patent Number: 5,704,180

[45] Date of Patent: Jan. 6, 1998

[54] INSULATING CONCRETE FORM UTILIZING INTERLOCKING FOAM PANELS

[75] Inventor: Erwin Boeck, Munich, Germany

[73] Assignee: Wallsystems International Ltd., Bank Lake Nassau, Bahamas

[21] Appl. No.: 717,754

[22] Filed: Sep. 23, 1996

Related U.S. Application Data

[63] Continuation-in-part of Ser. No. 240,278, May 10, 1994, abandoned.

[51] Int. Cl.[6] ..... E04B 2/00

[52] U.S. Cl. ..... 52/426; 52/309.12; 52/564; 52/444; 249/40; 249/216

[58] Field of Search ..... 52/309.12, 426, 52/427, 428, 439, 444, 562, 563, 564; 249/40–47, 216, 218, 35, 191, 192

[56] References Cited

U.S. PATENT DOCUMENTS

| | | | |
|---|---|---|---|
| 994,027 | 5/1911 | O'Beirne . | |
| 1,345,156 | 6/1920 | Flynn . | |
| 1,751,748 | 3/1930 | Nash . | |
| 2,029,082 | 1/1936 | Odam | 52/564 X |
| 2,134,894 | 11/1938 | Schubert . | |
| 2,181,698 | 11/1939 | Langenberg | 52/564 X |
| 3,788,020 | 1/1974 | Gregori | 52/426 X |
| 4,439,967 | 4/1984 | Dielenberg . | |
| 4,516,364 | 5/1985 | Heider . | |
| 4,604,843 | 8/1986 | Ott et al. . | |
| 4,660,342 | 4/1987 | Salisbury . | |
| 4,706,429 | 11/1987 | Young . | |
| 4,731,968 | 3/1988 | Obino . | |
| 4,765,109 | 8/1988 | Boeshart . | |
| 4,866,891 | 9/1989 | Young | 52/309.12 X |
| 4,884,382 | 12/1989 | Horobin . | |
| 4,889,310 | 12/1989 | Boeshart . | |
| 4,916,879 | 4/1990 | Boeshart . | |
| 4,936,540 | 6/1990 | Boeshart | 249/40 X |
| 5,390,459 | 2/1995 | Mensen | 52/426 |

FOREIGN PATENT DOCUMENTS

| | | | |
|---|---|---|---|
| 1072766 | 3/1980 | Canada . | |
| 1234701 | 4/1988 | Canada . | |
| 117443 | 9/1984 | European Pat. Off. . | |
| 118374 | 9/1984 | European Pat. Off. . | |
| 374064 | 6/1990 | European Pat. Off. . | |
| 2500256 | 7/1976 | Germany . | |
| 2838052 | 3/1990 | Germany | 52/562 |
| 4016673 | 1/1992 | Japan | 249/216 |
| 335834 | 3/1959 | Switzerland . | |
| 0614711 | 12/1948 | United Kingdom | 52/562 |
| 700325 | 11/1953 | United Kingdom . | |

OTHER PUBLICATIONS

"Ice Block" 1992 brochure and related materials of W.A.M. Inc., Maquoketa, Iowa.

(List continued on next page.)

*Primary Examiner*—Carl D. Friedman
*Assistant Examiner*—Winnie S. Yip
*Attorney, Agent, or Firm*—Oppenheimer Poms Smith

[57] ABSTRACT

A concrete form system in which a plurality of foam panels are interlocked transversely, horizontally and vertically by a plurality of connectors. The panels have opposed upper and lower ends, with a plurality of coplanar passages extending into the upper ends at regularly spaced intervals. An equal plurality of coplanar passages extend into the panels' lower ends at the same regularly spaced intervals to vertically align each upper end passage with a corresponding lower end passage. Each connector has a first bar which interconnects transversely opposed first and second parallel, vertically extending planar segments; and, a second bar interconnecting identical transversely opposed third and fourth parallel, vertically extending planar segments. A latticework interconnects the two bars in spaced parallel relationship and maintains separate coplanar alignment of (i) the first and third planar segments, (ii) the second and fourth planar segments, and (iii) the two bars. The upper and lower end panel passages are sized and shaped to receive corresponding halves of one of the connector planar segments.

18 Claims, 6 Drawing Sheets

OTHER PUBLICATIONS

"AAB Building Systems" undated brochure of AAB Building System of British Columbia Ltd., Port Alberni, British Columbia, Canada.

"Insulock" undated brochure.

"Reddi–Form" 1992 brochure of Reddi–Form Inc., Fairless Hills, PA.

"Argisol" 1993 brochure of The Greenblock Company Ltd., Woodland Park, Colorado.

"SmartBlock Homes" undated brochure of American Conform Industries Inc., Santa Ana, CA.

"SmartBlock Basements" 1992 brochure of American Conform Industries Inc., Santa Ana, Ca.

"When You Build To Last" undated brochure of American Conform Industries Inc., Santa Ana, CA.

"Inform" undated brochure and related materials of Inform Canada Industries Ltd., Vancouver, B.C., Canada.

"SmartStrip" 1993 brochure of American Conform Industries Inc., Santa Ana, CA.

1993 "Technical Manual" of AAB Building System of British Columbia Ltd., Port Alberni, British Columbia, Canada.

"KEPS" undated brochure, technical manual and related materials of Kepsystem, Inc., St. Eustache, Quebec, Canada.

"The R–Forms Building System" 1993 (?) brochure of R–Forms, Inc., Palm Beach Gardens, Florida.

"Lightweight Concrete Wall Forming Ststem" 1993 brochure and related materials of Lite–orm Inc., Sioux City, Iowa.

INSULATING CONCRETE FORM UTILIZING INTERLOCKING FOAM PANELS

REFERENCE TO RELATED APPLICATION

This is a continuation-in-part of U.S. application Ser. No. 08/240,278 filed 10 May, 1994, now abandoned.

FIELD OF THE INVENTION

This application pertains to forms for casting concrete walls in building construction. A plurality of easily-handled foam panels are interlocked together to construct a form of desired size and shape into which concrete is poured. When the concrete sets it forms a wall of the desired size and shape. The foam panels remain attached to the wall and serve as insulation.

BACKGROUND OF THE INVENTION

The prior art discloses a variety of interlockable foam panel systems of the foregoing type, U.S. Pat. No. 4,884,382 Horobin issued 5 Dec., 1989 being generally representative. Horobin provides a plurality of plastic connectors which are used to interlock the foam panels and hold them in spaced, parallel relationship. When seen in vertical cross-section, the opposed ends of Horobin's connectors have "T" shapes. A plurality of mating "T" shaped slots extend, at spaced intervals, vertically from the top of each foam panel to a point just below the mid-section thereof. Two panels are interlocked by aligning them with their slotted faces opposing one another. The "T" ends of a connector are placed over a corresponding pair of opposed slots and the connector is pushed down to fully insert the "T" shaped connector portions into the opposed panel slots. Further connectors are similarly inserted between additional pairs of slots at spaced intervals along the panels.

The foregoing arrangement weakens the foam panels by requiring that they be deeply slotted. Each panel has a plurality of slots, with each slot cutting through about ⅔ of the height and about ⅞ of the width of the panel. The present invention, while providing a convenient panel interlocking mechanism, does not require slots which cut through a significant portion of each panel, thereby avoiding weakening of the panel.

Unlike the prior art connectors, which interlock the foam panels only transversely, connectors constructed in accordance with the invention interlock the panels transversely, horizontally and vertically, thus significantly improving the structural integrity of a completed foam panel concrete form. Applicant's connectors are also capable of interlocking not only between adjacent foam panels but also between a panel and another connector, thereby simplifying construction of corner walls and eliminating the need for specially formed end walls. These and other advantages of the invention are hereinafter explained in greater detail.

SUMMARY OF THE INVENTION

In accordance with the preferred embodiment, the invention provides a foam panel for constructing a concrete form. The panel has opposed upper and lower ends, with a plurality of coplanar passages extending into the upper end at regularly spaced intervals. An equal plurality of coplanar passages extend into the panels lower end at the same regularly spaced intervals. Thus, each upper end passage is aligned vertically with a corresponding one of the lower end passages. An angular passage perpendicularly intersects the respective upper or lower end passages and extends toward but not substantially through an inward longitudinal face of the panel.

To simplify accurate cutting of the panels in construction of custom length forms, at least one score mark is provided for each vertically aligned pair of upper and lower end passages. The score marks are centred over the respective paired passages and preferably extend vertically across both outer longitudinal faces of the panel.

The invention further provides a connector for interlocking two or more foam panels to construct a concrete form. The connector has a first bar which interconnects transversely opposed first and second parallel, vertically extending planar segments, and a second bar interconnects identical transversely opposed third and fourth parallel, vertically extending planar segments. A latticework interconnects the two bars in spaced parallel relationship and maintains separate coplanar alignment of (i) the first and third planar segments, (ii) the second and fourth planar segments, and (iii) the two bars.

The vertical extension of the first, second, third and fourth planar segments is equal. The interconnections between the two bars and the respective planar segments comprise flared angular projections on the bars, the projections respectively extending upwardly or downwardly from points on the bars spaced inwardly from the segments to respective outer ends of the segments.

The two bars are notched for interlocking engagement of a bar of one connector with a bar of another connector. Additional bar notches may be provided to support one or more reinforcing rods laid transversely across the bars.

The invention thus provides a complete concrete form system, comprising a plurality of foam panels and a plurality of connectors as described above. The upper and lower end panel passages are sized and shaped to receive a corresponding half of one of the connector planar segments. In particular, the upper and lower end passages have a depth which slightly exceeds half the vertical extension of the connectors' planar segments; and, the width of each passage slightly exceeds the width of one of the connector planar segments.

The interval spacing between the passages equals the displacement between the connector bars, thus ensuring alignment between the two pairs of coplanar segments on each connector and corresponding pairs of passages in the panels' upper and lower ends.

The size and shape of the panels' angular passages corresponds to that of the flared angular projections on the connector bars. Accordingly, those projections are received within the angular passages as the connectors' planar segments are received within the coplanar panel passages.

DETAILED DESCRIPTION OF THE PREFERRED EMBODIMENT

Figure 1:
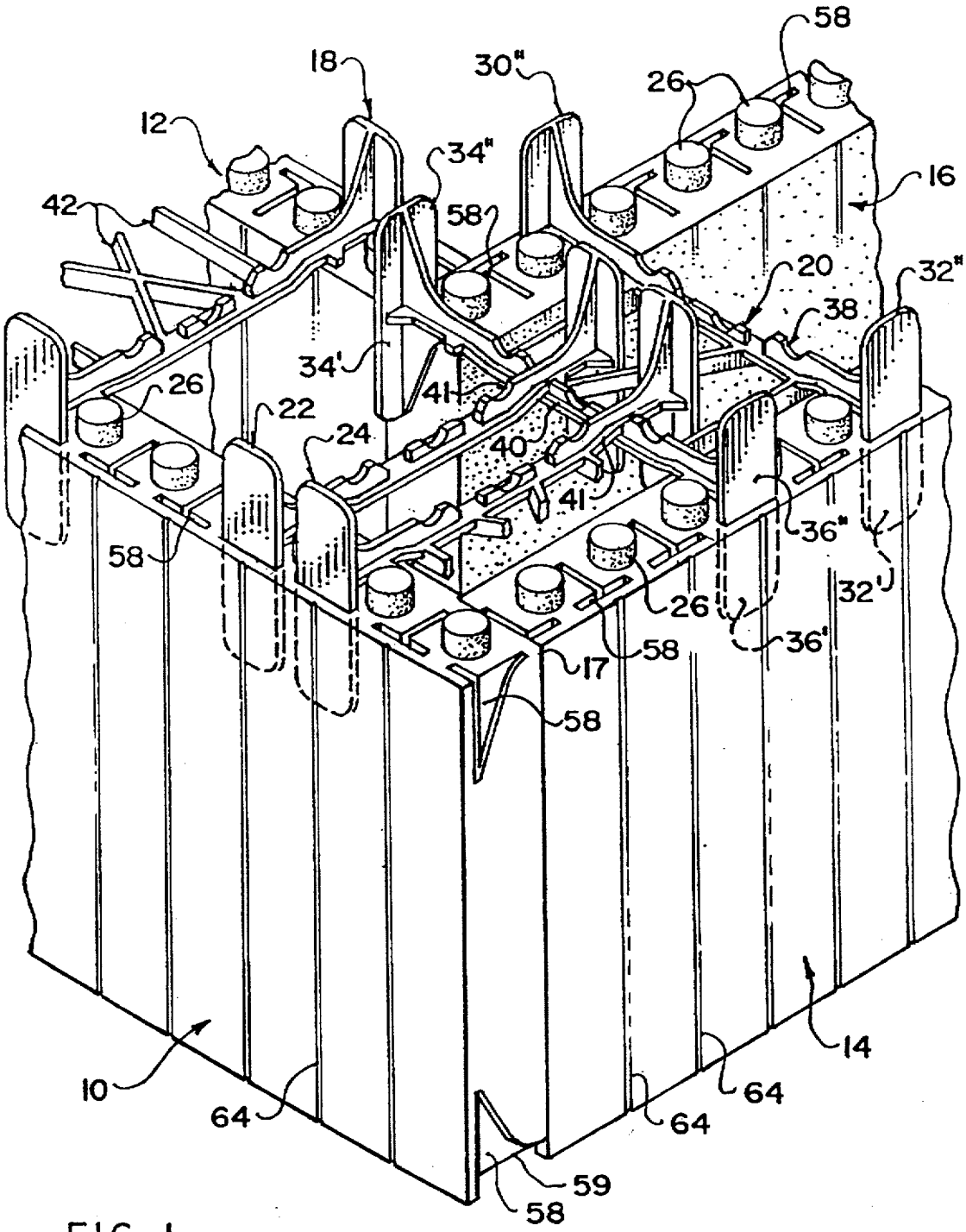
FIG. 1 is an isometric illustration of a concrete form constructed in accordance with the preferred embodiment of the invention, showing portions of four foam panels intersecting at right angles to form a corner wall; and showing the capability of the connectors to interlock between adjacent panel sections or between a panel and another connector.

FIG. 1 illustrates portions of four identical expanded polystyrene foam panels 10, 12, 14, 16 interlocked with the aid of connectors 18, 20, 22 and 24 to form a corner wall. The connectors hold panel pairs 10, 12; and, 14, 16 in fixed, spaced, parallel relationship, thereby defining the thickness dimension of each wall segment. Note that the narrow end of panel 14 butts against the inward face of panel 10; and, the narrow end of panel 12 butts against the outward face of panel 16. Vertically extending indentations 17 are provided at both ends on one face of each panel to eliminate thickness variations at the outer butt joints. Tape (not shown) may be applied around the outer corner joint between panels 10, 14 to improve structural rigidity at these corner interfaces.

The upper, longitudinally extending ends of each foam panel are formed with a plurality of upwardly extending protrusions 26 at regularly spaced intervals along each such end. A plurality of mating recesses 28 (FIG. 6) are formed at corresponding intervals along the lower end of each panel. Protrusions 26 and recesses 28 facilitate vertical alignment of panels atop one another to form a wall section of desired height as described below. Confinement of recesses 28 to the lower end of each panel assists somewhat in preventing entrapment of foreign matter within the recesses.

In prior art assemblies, interlocking engagement between foam parts analogous to protrusions 26 and recesses 28 is a major (perhaps the only) means of providing structural integrity across the joint between two panels stacked vertically atop one another. The invention significantly improves structural integrity at such joints, decreasing their tendency to burst open when subjected to high loads imposed by heavy wet concrete. This is particularly important at joints between panels forming the lower part of relatively high walls (for example 8 to 10 feet in height). The connector provided by the invention to facilitate these and other advantages will now be described.

Figure 4:
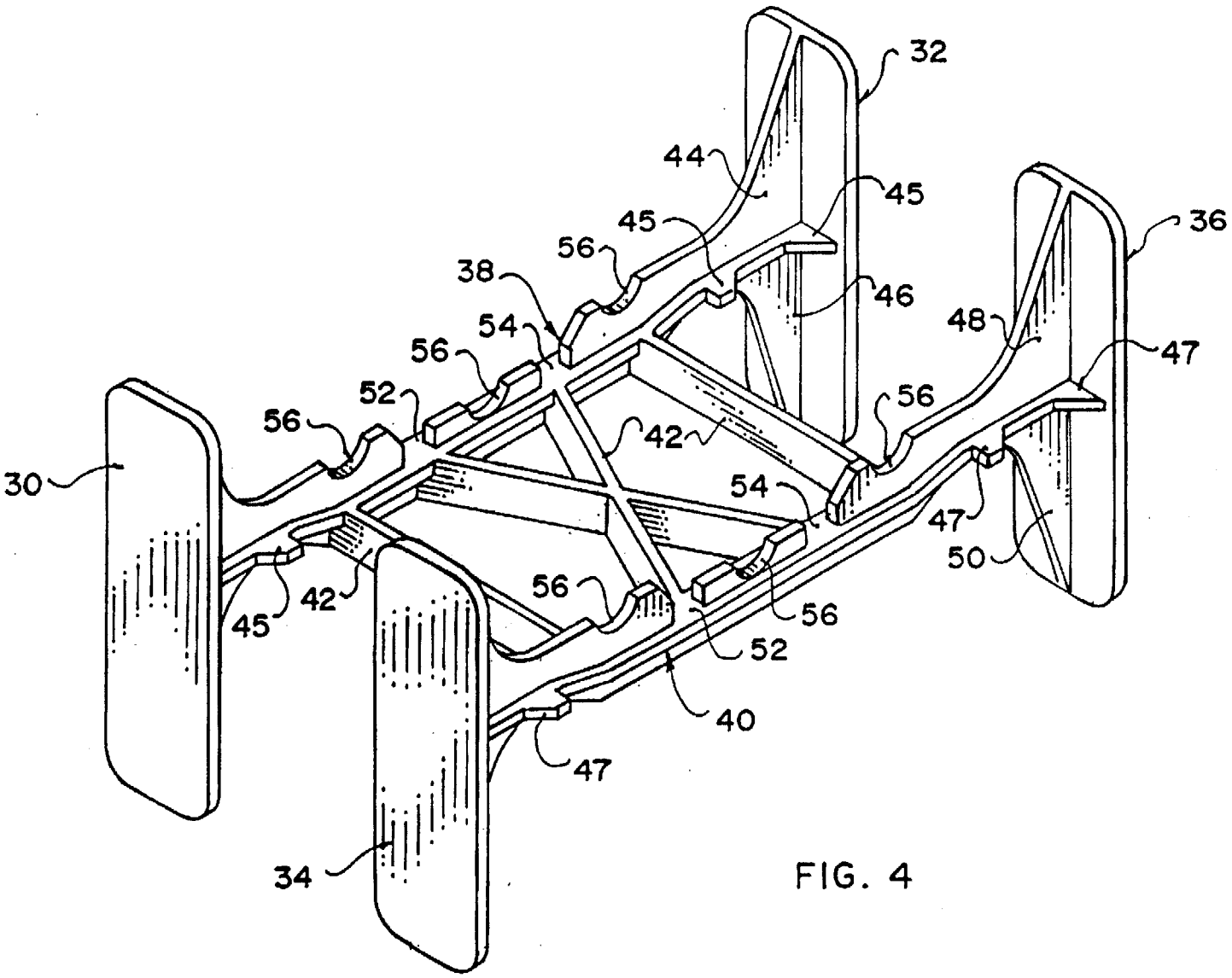
FIG. 4 is an isometric illustration of a connector constructed in accordance with the preferred embodiment of the invention.

FIG. 4 illustrates the preferred form of connector used to interlock foam panels in accordance with the invention. Each connector has four outwardly disposed, parallel, vertically extending planar members 30, 32, 34, 36. Bars 38, 40 respectively extend between planar members 30, 32 and 34, 36 to hold them in fixed, spaced, parallel relationship with members 30, 34 being coplanar; and, members 32, 36 being coplanar. The vertical extension of each of members 30, 32, 34, 36 away from bars 38, 40 is equal. The connectors are preferably unitary plastic castings. Bars 38, 40 are in turn rigidly interconnected by latticework 42 which maintains a fixed displacement between bars 38, 40. The ends of bars 38, 40 flare outwardly and upwardly to merge with the outer ends of the respective planar members, as illustrated, for example, by reference numerals 44, 46, 48 and 50. As explained in greater detail below, this enhances the connector's structural integrity without unduly weakening the foam panels. Opposed pairs of notches 52, 54 are provided in the upper central portions of bars 38, 40 to facilitate interlocking of connectors as hereinafter described. Additional, somewhat shallower notches 56 are provided in the upper portions of bars 38, 40 to receive reinforcing rods as hereinafter described. But for the requirement that bars 38, 40 and notches 52, 54 be shaped and sized for interlocking engagement as hereinafter described, the cross-sectional shape of bars 38, 40 is arbitrary.

Figure 6:
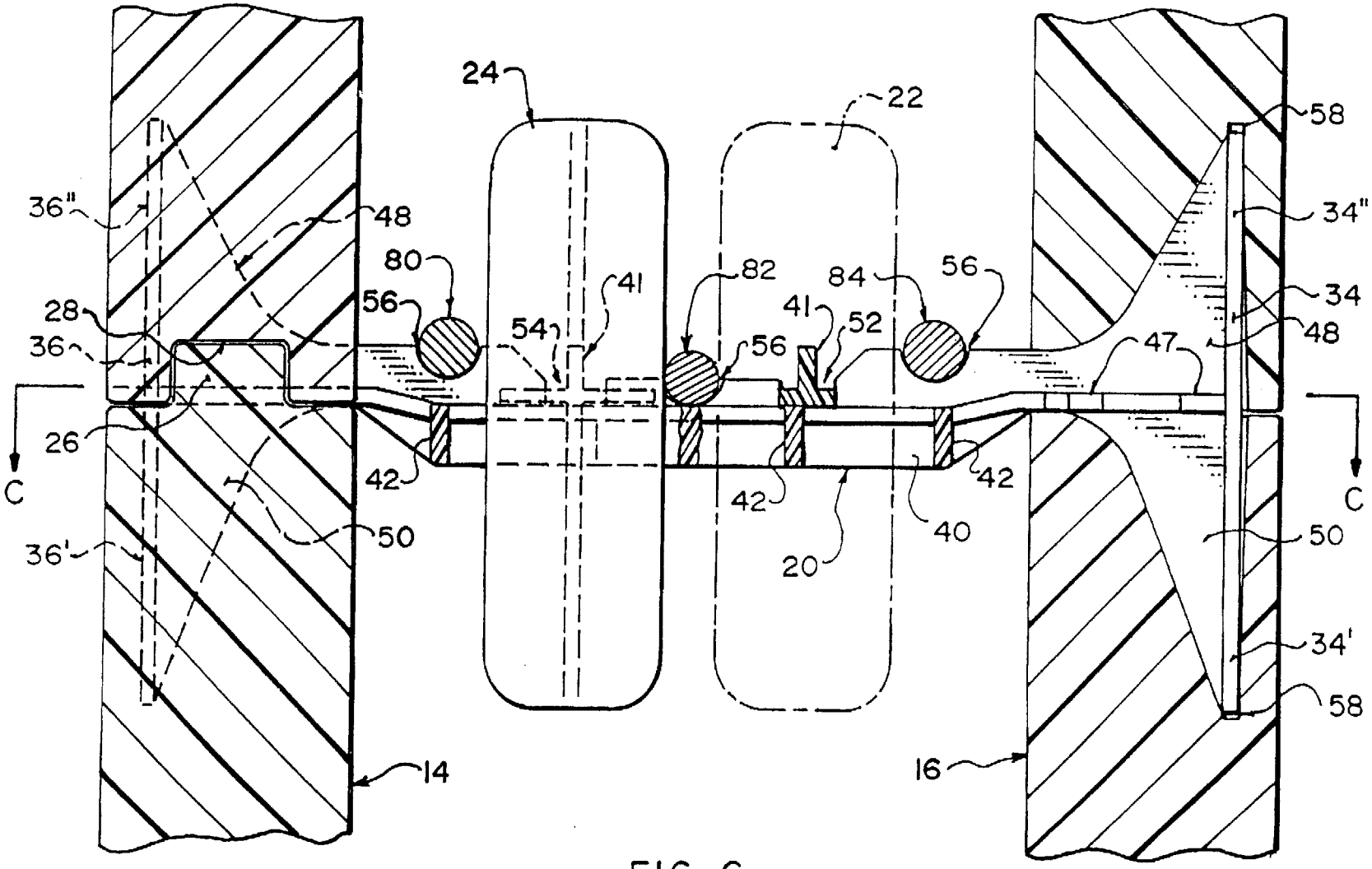
FIG. 6 is a cross-sectional illustration taken generally with respect to line 6—6 of FIG. 5.

Returning to FIGS. 1 and 2, and with further reference to FIG. 6, it will be noted that connectors 18 and 20 are both "full size" connectors, whereas connectors 22 and 24 are each "half-width" connectors formed by breaking the latticework 42 of a full connector to separate the full connector into two half-width connectors, one half-width generally comprising planar members 30, 32 interconnected by bar 38; and the other generally comprising planar members 34, 36 interconnected by bar 40. The half-width connectors so formed are substantially identical because each full connector is symmetrical about a vertically extending plane located mid way between bars 38 and 40.

A plurality of coplanar passages 58 are formed in both the upper and lower ends of each foam panel, parallel to the panel's longitudinal axis. The depth of each passage is slightly greater than one-half the vertical dimension of the connector's planar members 30, 32, 34, 36. Each of passages 58 is perpendicularly intersected by an angular or somewhat skewed "V" shape passage conforming to the shape of flared parts 44, 46, 48, 50 which define the intersection between bars 38, 40 and the connectors' planar members. This angular or skewed shape is seen, for example, at the upper and lower portions of the foremost end of panel 10 seen in FIG. 1; and, may also be seen in the cross-sectional illustration of FIG. 6 (in which the passages in vertically opposed panels are occupied by the planar members of a connector which vertically interconnects the panels). Note that the angular or skewed "V" shape passages do not extend through the inwardly opposed faces of the panels, except over a small depth required to accommodate the vertically extending portions of connector bars 38, 40 when the connectors and panels are fully interlocked together. Also note that passages 58 taper slightly from top to bottom, as seen in FIG. 6. This ensures that the connector legs are firmly gripped when fully inserted into the passages, without impeding initial insertion of the connectors into the passages.

Figure 5:
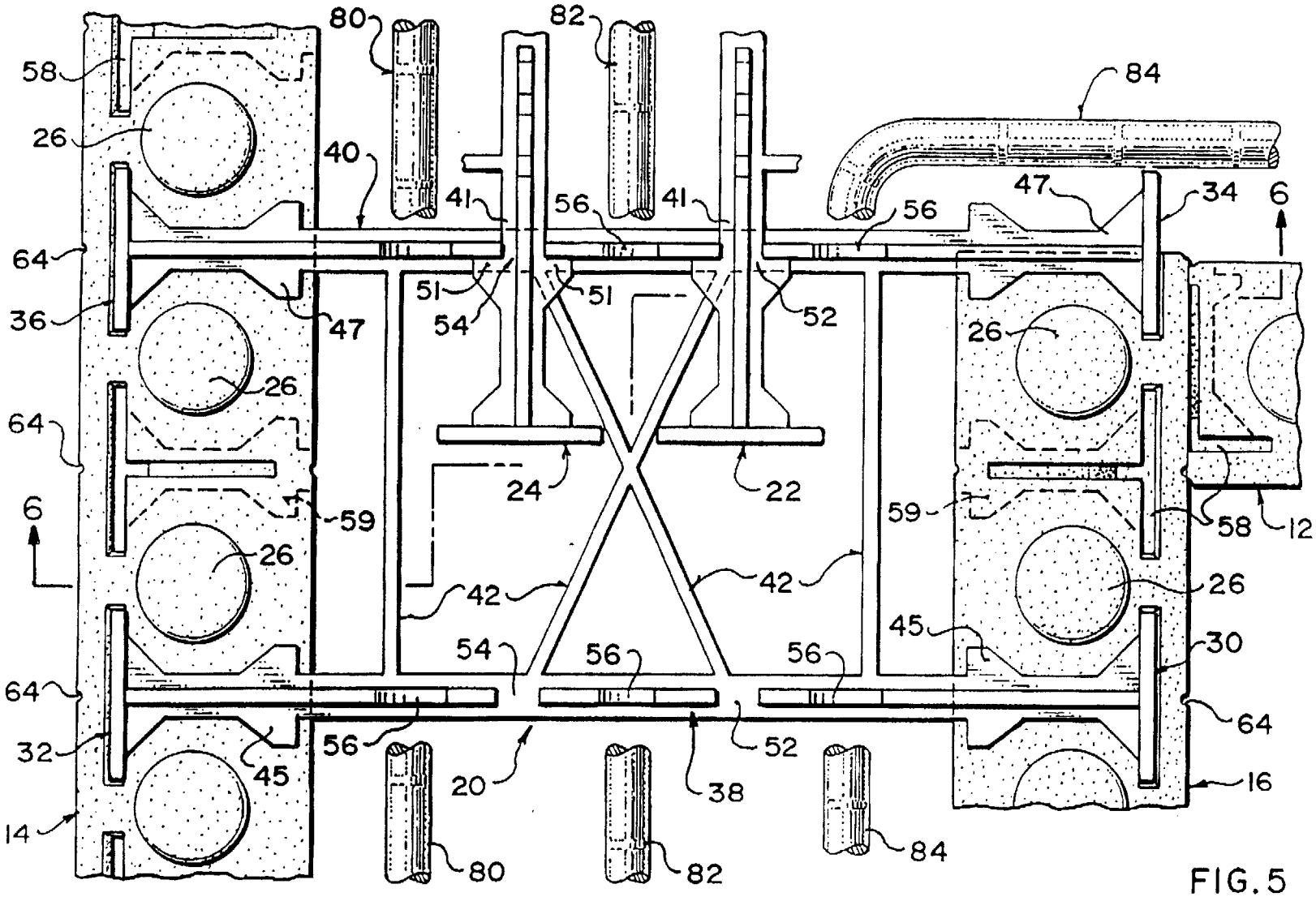
FIG. 5 is a detailed plan view of a portion of the FIG. 1 structure, additionally showing the placement of reinforcing rods within the forms.

The lower ends of each panel are provided with recesses 59 (best seen, in hidden outline, in FIG. 5) in vertical opposition to each of passages 58. Recesses 59 have shapes corresponding to the horizontal cross-sectional shape at points 45, 47 (FIG. 4) near where bars 38, 40 meet planar members 30, 32, 34, 36. The recesses receive bar portions 45, 47 when the connectors are inserted into the foam panels, thereby preventing them from interfering with flush engagement of the upper and lower ends of vertically opposed panels. FIG. 5 also shows, at 51, how bar portions 45, 47 brace one connector against one of the bars of another connector when two connectors are themselves interlocked at a corner joint. This assists in distributing forces throughout a web of interconnected connectors, further improving structural integrity of panels interconnected in accordance with the invention.

Passages 58 are formed at regularly spaced intervals (preferably on two inch centres, starting from the end of the panel) corresponding to the distance between the connectors' planar members 30, 34 and 32, 36 to facilitate placement of connectors at spaced intervals along the panels. As seen in FIG. 1, for example, the downwardly protruding legs 32', 36' of connector 20 have been inserted into a corresponding pair of passages in panel 14 on either side of an unused passage; and, the opposed downwardly protruding legs on the opposite side of connector 20 have been inserted into a transversely aligned pair of passages in panel 16, again on either side of an unused passage. (The left hand lower leg 34' extends only partially within panel 16, since panel 16 has been cut along a line which bisects the passage receiving leg portion 34', to form the wall corner.)

Figure 3:
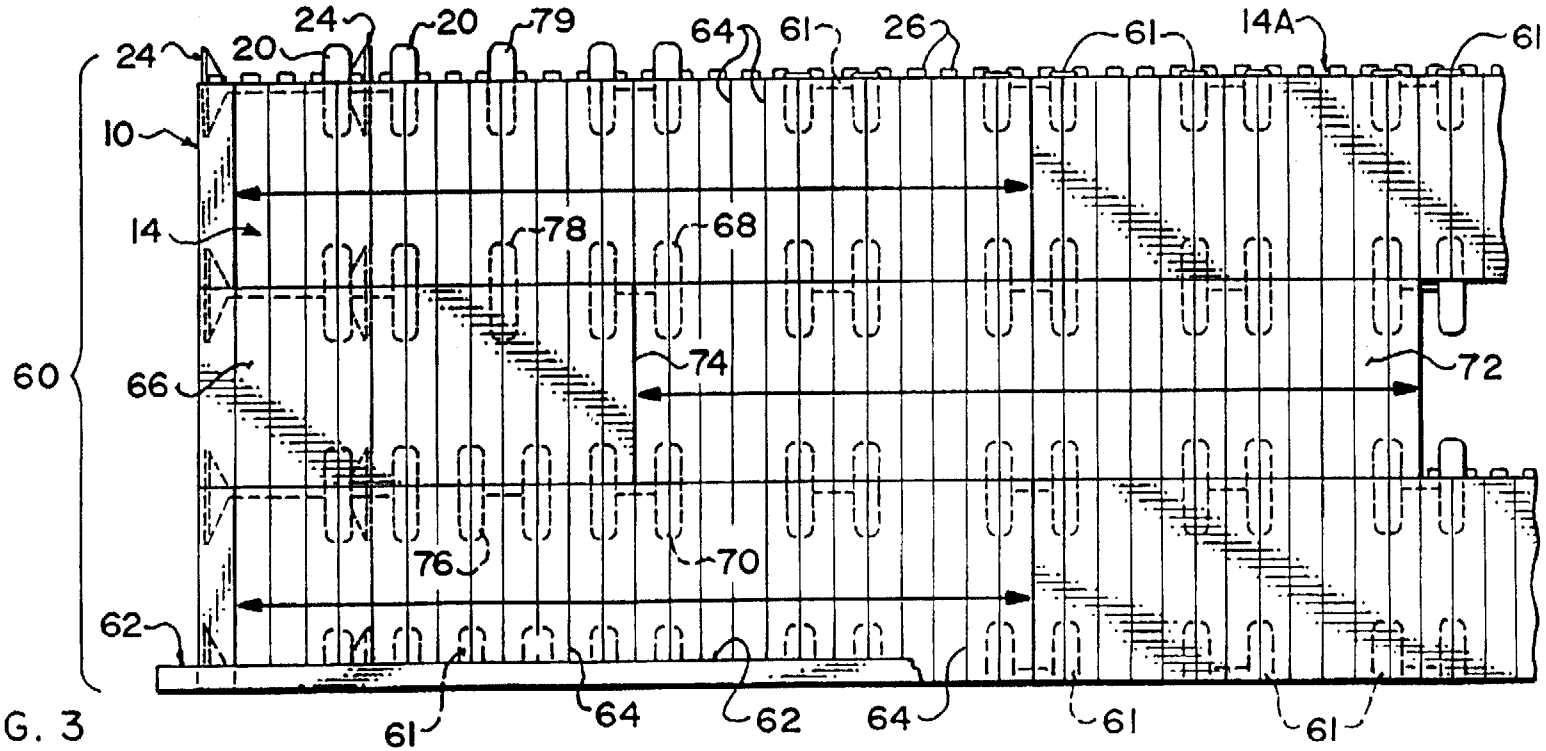
FIG. 3 is an elevation view of the FIG. 2 structure, showing how the connectors interlock both horizontally and vertically adjacent panel sections.

When connector 20 is fully inserted into panels 14, 16 (as seen in FIG. 1) leg portions 32", 36" and 30", 34" protrude upwardly, respectively, above panels 14, 16. Because each connector is symmetrical about the plane containing lattice-work 42, and because the lower ends of each panel are formed with passages each of which are identical to, vertically aligned with and coplanar with a corresponding one of the upper end passages, one can easily vertically interlock the panels, as best seen in FIG. 3. This is done by aligning the lower end passages in a fresh panel over the upwardly protruding leg portions of the connectors in another panel and pushing the fresh panel down to seat the leg portions within the lower end passages. The same action seats protrusions 26 of the one panel within recesses 28 of the other panel.

Referring then to FIG. 3, it will be seen that a wall section 60 comprising a plurality of rows of vertically aligned foam panels is formed adjacent toe plates 62, which may be a 2×4 or similar suitable structural member for supporting the lowermost edges of the bottom panels. The forward facing portion of wall section 60 comprises six foam panels, with two panels in each of three vertically aligned rows.

In addition to the "full size" connectors, a plurality of "half-height" connectors 61 are provided. The half-height connectors are formed separately by bisecting a full size connector along a plane containing latticework 42, as shown by line C—C in FIG. 6. The half-height connectors thus have planar members which extend vertically away from only one side of the half-height connectors latticework. The planar members of the half-height connectors are inserted into the top edge of panels forming the top row in a wall section; or (inverted) into the bottom edge of panels forming the bottom row in a wall section. Because the half-height connectors have no oppositely protruding planar members (i.e. the half-height connectors have no leg portions 30", 32", 34" or 36") the top and bottom edges of the wall section remain flat. [Note that whereas half-width connectors may be formed on the job site by manually breaking the lattice-work of full size connectors as previously explained, half-height connectors are formed separately and supplied with the full size connectors.]

The full longitudinal extent of one of the panels in each row is indicated by the double-arrowed lines in FIG. 3. Note that the butted, vertically-extending ends of longitudinally adjacent panels are staggered from one vertically adjacent row to the next to avoid compromising structural integrity. This is achieved by cutting panels to a desired length by slicing along one of the vertically extending score marks 64 provided on the outer faces of each panel. For example, panel 66 seen in FIG. 3 has been cut at its left end to produce a half length panel in order to achieve the staggered effect aforesaid. Score marks 64' lying at one foot intervals can be widened or otherwise made more distinctive to simplify alignment and affixation of the panels to wall studs.

Connectors are placed to bridge across the butted ends of longitudinally adjacent panels to further strengthen the concrete form. This is illustrated, for example, by connectors 68 and 70 which are respectively inserted into the upper and lower ends of longitudinally adjacent panels 66, 72 to bridge across butt joint 74 at which panels 66, 72 meet. Also note the optional use of additional connectors to provide further wall strengthening at any desired location. For example, in FIG. 3, additional full size and half-width connectors 76, 78, 79 are employed to further strengthen the wall near the corner joint. It can thus be seen that the provision of connector-receiving passages 58 on two inch centres along the entire longitudinal extent of the upper and lower ends of each panel yields great flexibility in selection of connector insertion points, and enhances the ability to increase the wall's structural integrity in selected regions. Prior art systems, by contrast, typically offer less flexibility in connector positioning, thus reducing the ability to strengthen wall sections at points where increased forces are expected.

Figure 2:
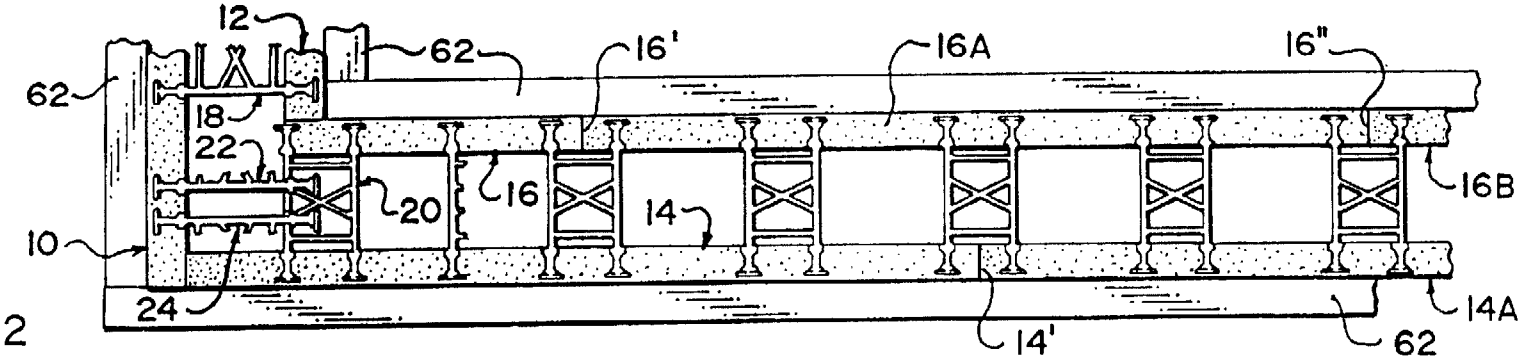
FIG. 2 is a plan view of the FIG. 1 structure, showing an extended portion of one of the wall segments and showing how the connectors interlock transversely between opposed panel sections.

As seen in FIG. 2, transversely opposed panels are also staggered so that a butt joint between two longitudinally opposed panels does not face a butt joint in the opposite panels. Note in particular butt joint 14' between panels 14, **14*a* lies between butt joints 16' and 16" which respectively separate panels 16, 16*a* and 16*a*, 16*b* thereby further enhancing structural integrity of the wall section. FIG. 2 also illustrates a further advantage of lattice-work 42 in each full-size connector; namely resistance to "wracking" forces which tend to cause panels 14, 16** to slip in longitudinally opposed directions. For example, if only half-width connectors were used, wracking forces could disrupt the transverse spacing between the panels, resulting in undesirable reduction in width of the finished wall.

If desired, a single full size connector can be used to interconnect as many as eight panels transversely, horizontally and vertically. Specifically, the two co-planar, downwardly protruding legs on one side of a full size connector can be bridged across the butted ends of two longitudinally adjacent panels. The two upwardly protruding legs on the same side of that connector can be bridged across the butted ends of another two longitudinally adjacent panels placed atop the first two panels. The same arrangement is repeated to interlock another four panels on the opposite side of the same connector. (In this case the butt joints are not staggered from one vertically adjacent row of panels to the next, nor are the transversely opposed butt joints staggered on opposite sides of the wall).

FIGS. 1, 2, 5 and 6 illustrate the manner in which half-width connectors can be used to interlock foam panels with other connectors, thereby simplifying and strengthening the construction of corner walls. More particularly, bar portions 41 of each of half-width connectors 22, 24 are shown in interlocking engagement with notches 52, 54 respectively of bar 40 in connector 20. Notches 52, 54 and bars 38, 40 are formed in each connector for snap-fitting engagement of either of bars 38 or 40 within either of notches 52, 54 in order to facilitate interlocking of the connectors as aforesaid.

As shown in FIGS. 5 and 6, conventional concrete reinforcing rods ("rebar") 80, 82, 84 may be aligned within the forms by placing such rods atop the connectors, within notches 56 provided in the upper portions of each of bars 38, 40 in every connector.

Figure 7B:
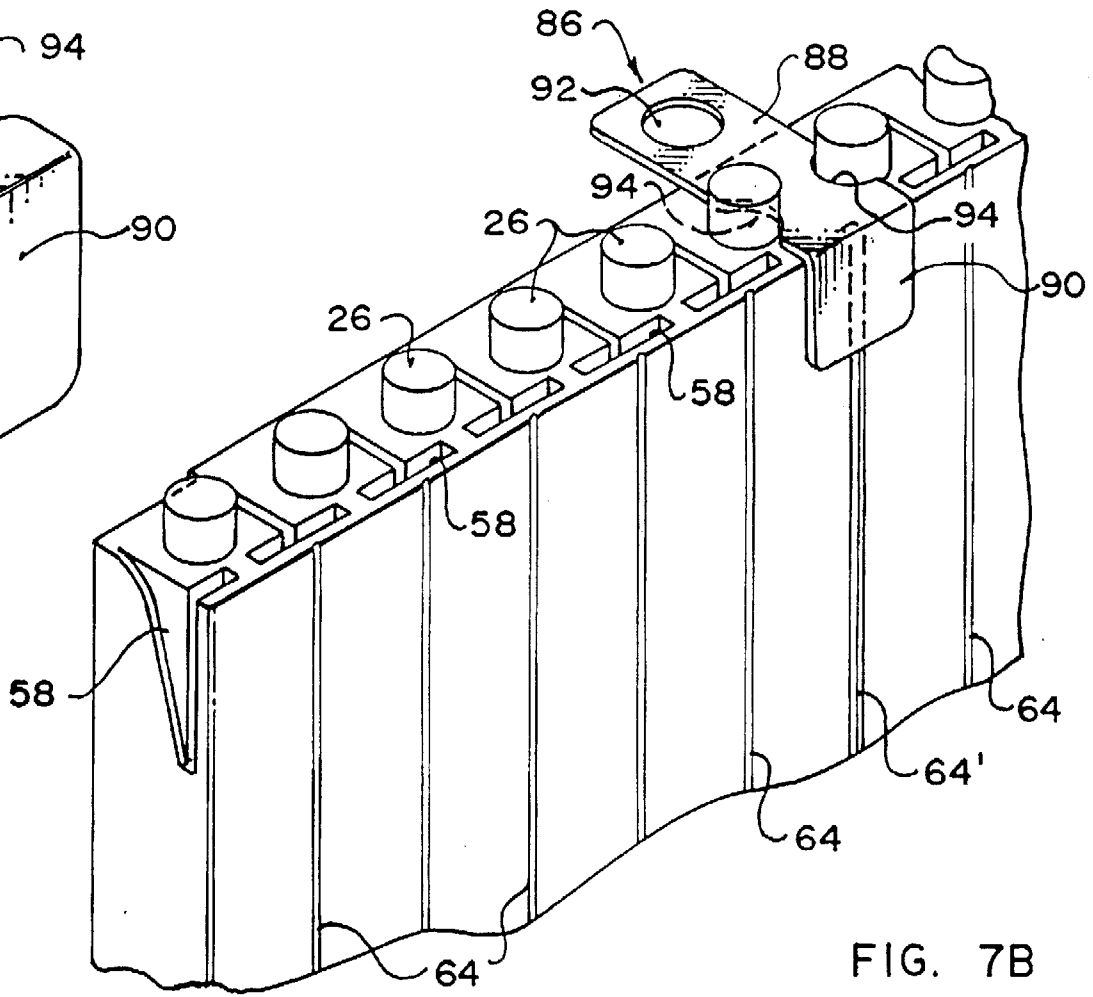
FIG. 7B is an isometric illustration showing the retention clip in position on a panel.
Figure 7A:
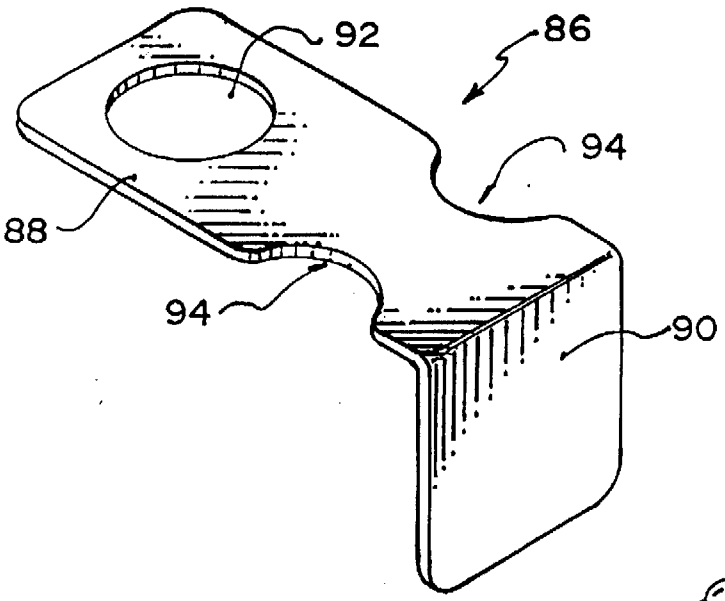
FIG. 7A is an isometric illustration of a retention clip for wall finishing material.

Plywood, drywall (also known as "wall board" or "sheet rock") or other wall finishing material can be fastened directly to the foam panels, which remain as insulation on both sides of the wall. Prior art systems have however had trouble meeting fire safety code standards in such situations. Specifically, the high temperatures encountered in a fire may destroy the foam panels, or may destroy the adhesive which is sometimes used to bond the finishing material to the inside wall panels, allowing the wall finishing material to collapse into the room. This problem is addressed by clip 86 depicted in FIGS. 7A and 7B, which will now be described.

Clip 86 has legs 88, 90 which protrude at right angles to one another. An aperture 92 and rounded notches 94 are provided in leg 88. Legs 88, 90 are sized so that notches 94 fit snugly between an adjacent pair of protrusions 26 atop the foam panel, with leg 90 lying flat against the panel's outer face and leg 88 extending rearwardly, well beyond the panel's inner face. This leaves aperture 92 in the region into which concrete is poured, thus allowing concrete to form and harden through aperture 92, fastening clip 86 firmly to the wall. In practice, a series of clips 86 are provided at intervals along the top of the wall. The wall finishing material is fixed in place by nailing or screwing through the finishing material and through leg 90. In the event of a fire the finishing material remains suspended by clips 86, notwithstanding fire damage to the foam panels. Note that score marks 64 are aligned between protrusions 26 (FIG. 3) thus simplifying location of clips 86 during the nailing/screwing operation.

Several advantages of the invention are noted in summary:

1. Prior art connectors typically transversley interlock foam panels by bridging between the mid-sections of two transversely opposed panels. Thus, the only direct support at the joint between two panels stacked vertically atop one another is provided by interlocking of the foam panels themselves, which is relatively weak. By contrast, Applicant's connectors bridge directly across the joint, significantly increasing the resistance to forces encountered at the joint.
2. Applicant's connectors bridge a significant distance across the joint and project deeply into the panels, preventing outward bowing of the panels and maintaining the wall flat.
3. Applicant's full size connectors can be placed to interconnect the foam panels transversely (i.e. bridge the gap between two panels on opposite sides of the wall section), horizontally (i.e. bridge across the butted ends of two longitudinally adjacent panels on the same side of the wall section) and vertically (i.e. bridge between two vertically adjacent panels on the same side of the wall section). This significantly enhances structural integrity of the wall section.
4. The connector-receiving passages in Applicant's panels do not weaken the panels by cutting significantly through the panels' outer faces, as in some prior art systems.
5. Half-height connectors provide structural integrity along the top and bottom of the wall section, which is often lacking in prior art systems.
6. Corner joints can be strengthened significantly by interlocking between the connectors themselves.
7. The connectors do not extend completely through the panels from one side to the other. In other words, the connectors can not form a thermal bridge through the panels, which can cause condensation problems and reduce the panels' insulating quality.

As will be apparent to those skilled in the art in the light of the foregoing disclosure, many alterations and modifications are possible in the practice of this invention without departing from the spirit or scope thereof. For example, the length of connector bars 38, 40 can be varied to change the displacement between planar segments 30, 32 and 34, 36 thus facilitating construction of walls of different thicknesses. As another example, the "X" shaped portion of latticework 42 seen in FIG. 4 may in some cases impede concrete penetration through the central region of the connector, in which case the "X" shaped portion can be eliminated such that latticework 42 consists only of the bars extending between bars 38, 40 on either side of the "X" shaped segment. Accordingly, the scope of the invention is to be construed in accordance with the substance defined by the following claims.

What is claimed is:

1. A foam panel for constructing a concrete form, said panel characterized by:

(a) opposed upper and lower ends;

(b) a plurality of coplanar upper end passages, each of said upper end passages contained within and extending a preselected depth into said upper end, said upper end passages displaced at regularly spaced intervals along said upper end;

(c) a plurality of coplanar lower end passages, each of said lower end passages contained within and extending a preselected depth into said lower end, said lower end passages displaced at regularly spaced intervals along said lower end, each of said upper end passages being aligned vertically and coplanar with a corresponding one of said lower end passages; and, (d) for each of said upper and lower end passages, an angular passage perpendicularly intersecting said respective upper or lower end passage along said preselected depth and extending toward but not substantially through one longitudinal face of said panel.

2. A foam panel as defined in claim 1, further comprising:

(a) a plurality of protrusions projecting upwardly from said upper end, between said upper end passages, at regularly spaced intervals along said upper end; and, (b) a plurality of mating recesses in said lower end, located between said lower end passages and at regularly spaced intervals along said lower end; each of said protrusions being aligned vertically with a corresponding one of said recesses.

3. A foam panel as defined in claim 2, further comprising, for each vertically aligned pair of said upper and lower end passages, at least one score mark centred over said respective paired passages and extending vertically across a longitudinal face of said panel.

4. A connector for interlocking two or more foam panels to construct a concrete form, said connector characterized by:

(a) a first bar (38) interconnecting transversely opposed first and second parallel, vertically extending planar segments (30, 32);

(b) a second bar (40) interconnecting transversely opposed third and fourth parallel, vertically extending planar segments (34, 36);

(c) a latticework (42) spaced inwardly from said planar segments (30, 32, 34, 36), formed unitary and coplanar with and interconnecting said first and second bars in spaced parallel relationship to maintain:

(i) coplanar alignment of said first and third planar segments (30, 34); and, (ii) coplanar alignment of said second and fourth planar segments (32, 36).

5. A connector as defined in claim 4, wherein said latticework further maintains coplanar alignment of said first and second bars.

6. A connector as defined in claim 5, wherein said first, second, third and fourth planar segments have equal vertical extension relative to said first and second bars.

7. A connector as defined in claim 4, wherein said interconnections between said first and second bars and said respective planar segments comprise flared angular projections on said bars, said projections respectively extending upwardly or downwardly from points on said bars spaced inwardly from said segments to respective outer ends of said segments.

8. A connector as defined in claim 4, wherein said first and second bars are notched for interlocking engagement of said first and second bars with respective first and second bars of another connector as defined in claim 4.

9. A connector as defined in claim 4, wherein said first and second bars are notched to support one or more reinforcing rods laid transversely across said bars.

10. A concrete form system, comprising a plurality of spaced foam panels and a plurality of connectors interconnecting said spaced foam panels, wherein:

(a) each of said connectors is characterized by:

(i) a first bar interconnecting transversely opposed first and second parallel, vertically extending planar segments;

(ii) a second bar interconnecting transversely opposed third and fourth parallel, vertically extending planar segments;

(iii) a latticework spaced inwardly from said planar segments, formed unitary and coplanar with and interconnecting said first and second bars in spaced parallel relationship to lie inside a space between said foam panels and maintain:

(A) coplanar alignment of said first and third planar segments;

(B) coplanar alignment of said second and fourth planar segments;

(C) a fixed displacement between said bars;

(b) each of said panels is characterized by:

(i) opposed upper and lower ends;

(ii) a plurality of coplanar passages extending into said upper end at regularly spaced intervals along said upper end; and, (iii) a plurality of coplanar passages extending into said lower end at regularly spaced intervals along said lower end;

each of said upper end passages being aligned vertically and coplanar with a corresponding one of said lower end passages; and, each of said upper and lower end passages being sized and shaped to receive a corresponding half of one of said connector planar segments.

11. A concrete form system as defined in claim 10, wherein:

(a) said first, second, third and fourth planar segments have equal vertical extension relative to said first and second bars; and, (b) said upper and lower end passages have a depth which slightly exceeds half of said vertical extension.

12. A concrete form system as defined in claim 11, wherein said upper and lower end passages have a width which slightly exceeds the width of said respective planar segments.

13. A concrete form system as defined in claim 11, wherein said intervals between said upper and lower end passages are displaced apart by a distance equal to said displacement between said bars.

14. A concrete form system as defined in claim 11, further comprising, for each of said upper and lower end panel passages, an angular passage perpendicularly intersecting said respective upper and lower end passages and extending toward but not substantially through a longitudinal face of said panel; and wherein said interconnections between said first and second connector bars and said respective planar segments comprise flared angular projections receivable within said angular passages, said projections respectively extending upwardly and downwardly from points on said bars spaced inwardly from said segments to respective outer ends of said segments.

15. A concrete form system as defined in claim 11, wherein said latticework further maintains coplanar alignment of said first and second connector bars.

16. A concrete form system as defined in claim 11, wherein said first and second connector bars are notched for interlocking engagement of said first and second bars with respective first and second bars of another connector as defined in claim 11.

17. A concrete form system as defined in claim 11, wherein said first and second connector bars are notched to support one or more reinforcing rods laid transversely across said bars.

18. A concrete form system as defined in claim 11, wherein said panels each further comprise:

(a) a plurality of protrusions projecting upwardly from said upper ends, between said upper end passages, at regularly spaced intervals along said upper ends;

said form system further comprising a plurality of wall finishing material retention clips, each of said clips comprising:

(b) first and second legs joined substantially at right angles;

(c) an aperture in one of said legs near an end thereof away from said joint; and, (d) a pair of notches in opposed sides of said one leg for fixing said clip in position between an adjacent pair of said protrusions with said leg aperture extending horizontally beyond one outer face of said panel and with said other leg projecting downwardly against an opposed outer face of said panel.

* * * * *